US009252490B2

(12) United States Patent
Wei

(10) Patent No.: US 9,252,490 B2
(45) Date of Patent: Feb. 2, 2016

(54) MULTI-BAND ANTENNA AND ELECTRONIC DEVICE PROVIDED WITH THE SAME

(71) Applicant: Wistron NeWeb Corp., Hsinchu County (TW)

(72) Inventor: Shih-Chiang Wei, Hsinchu County (TW)

(73) Assignee: WISTRON NEWEB CORP., Hsinchu County (TW)

( * ) Notice: Subject to any disclaimer, the term of this patent is extended or adjusted under 35 U.S.C. 154(b) by 363 days.

(21) Appl. No.: 13/743,724

(22) Filed: Jan. 17, 2013

(65) Prior Publication Data

US 2014/0009342 A1 Jan. 9, 2014

(30) Foreign Application Priority Data

Jul. 3, 2012 (TW) ..... 101123878 A

(51) Int. Cl.

| | |
|---|---|
| ***H01Q 9/04*** | (2006.01) |
| ***H01Q 1/22*** | (2006.01) |
| ***H01Q 9/42*** | (2006.01) |
| ***H01Q 21/28*** | (2006.01) |
| ***H01Q 5/371*** | (2015.01) |

(52) U.S. Cl.

CPC ..... *H01Q 9/04* (2013.01); *H01Q 1/2266* (2013.01); *H01Q 5/371* (2015.01); *H01Q 9/42* (2013.01); *H01Q 21/28* (2013.01)

(58) Field of Classification Search

CPC ..... H01Q 9/04; H01Q 5/371; H01Q 21/28; H01Q 9/42; H01Q 1/2266

USPC ..... 343/702

See application file for complete search history.

(56) References Cited

U.S. PATENT DOCUMENTS

| | | | | |
|---|---|---|---|---|
| 7,425,924 | B2 * | 9/2008 | Chung et al. | 343/702 |
| 2003/0006936 | A1 * | 1/2003 | Aoyama et al. | 343/700 MS |
| 2010/0079350 | A1 * | 4/2010 | Lai et al. | 343/843 |
| 2012/0162022 | A1 * | 6/2012 | Wei | 343/700 MS |
| 2012/0293376 | A1 * | 11/2012 | Hung et al. | 343/702 |
| 2012/0306709 | A1 * | 12/2012 | Wu et al. | 343/767 |

* cited by examiner

*Primary Examiner* — Hoang V Nguyen
*Assistant Examiner* — Michael Bouizza
(74) *Attorney, Agent, or Firm* — SmithAmundsen LLC; Kelly J. Smith; Dennis S. Schell

(57) ABSTRACT

A multi-band antenna includes a ground plane, and a radiating unit including an L-shaped first radiating arm, a U-shaped second radiating arm, a feed-in arm and a coupling arm. The first and second radiating arms are connected to the ground plane, and have respective free end portions that are spaced apart from and overlap the ground plane, that face each other, and that define an opening in spatial communication with an inner space defined by the first and second radiating arms and the ground plane. The feed-in arm is disposed in the inner space between the first radiating arm and the ground plane, is connected to the ground plane, and overlaps the opening. The coupling arm is connected to the connecting segment, and overlaps the free end portions.

14 Claims, 18 Drawing Sheets

MULTI-BAND ANTENNA AND ELECTRONIC DEVICE PROVIDED WITH THE SAME

CROSS-REFERENCE TO RELATED APPLICATION

This application claims priority of Taiwanese Application No. 101123878, filed on Jul. 3, 2012.

BACKGROUND OF THE INVENTION

1. Field of the Invention

The present invention relates to a multi-band antenna and an electronic device provided with the same for communication purposes.

2. Description of the Related Art

A conventional electronic device is generally provided with a plurality of antennas corresponding respectively to different frequency bands. For example, a conventional electronic device may be provided with a dual-band inverted-F antenna covering frequency bands of 2.4~2.5 GHz and 5.15~5.875 GHz for Wireless Local Area Network (WLAN), and a single-band monopole antenna covering a frequency band of 3.3~3.8 GHz for Worldwide Interoperability for Microwave Access (WiMAX). Moreover, for each type of the dual-band inverted-F antenna and the single-band monopole antenna, the conventional electronic device requires at least two antennas in order to achieve signal diversity.

However, with the rapid development of wireless communication, the dual-band inverted-F antenna has become obsolete. Instead, there is a requirement of a single unitary multi-band antenna capable of covering all of the above-mentioned frequency bands or even a broader frequency band (e.g., 2.3~2.7 GHz).

Moreover, in order to achieve a better effect of the signal diversity, insertion loss between two multi-band antennas operating in a same frequency band should be smaller than −20 dB.

SUMMARY OF THE INVENTION

Therefore, an object of the present invention is to provide a multi-band antenna capable of alleviating the above disadvantages of the prior art, and an electronic device provided with the same.

Accordingly, a multi-band antenna of the present invention comprises a ground plane and a radiating unit. The radiating unit includes a substantially L-shaped first radiating arm, a substantially U-shaped second radiating arm, a feed-in arm and a coupling arm.

The first radiating arm has a first connecting end portion electrically connected to the ground plane, and a first free end portion that is spaced apart from and projectively overlaps a portion of the ground plane in a first direction. The second radiating arm has a second connecting end portion electrically connected to the ground plane, and a second free end portion that is spaced apart from and projectively overlaps a portion of the ground plane in the first direction. The second radiating arm cooperates with the first radiating arm and the ground plane to define an inner space therein. The first and second free end portions face each other and define an opening in spatial communication with the inner space therebetween.

The feed-in arm is disposed in the inner space, and includes a connecting segment electrically connected to the ground plane and projectively overlapping the opening in the first direction, and a feed-in segment electrically connected to the connecting segment and disposed between the first radiating arm and the ground plane. The coupling arm includes a main coupling segment electrically connected to the connecting segment and projectively overlapping the first and second free end portions in the first direction.

According to another aspect of this invention, an electronic device comprises a circuit module and the aforesaid multi-band antenna. The feed-in segment of the feed-in arm includes a signal feed-in point coupled to the circuit module.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
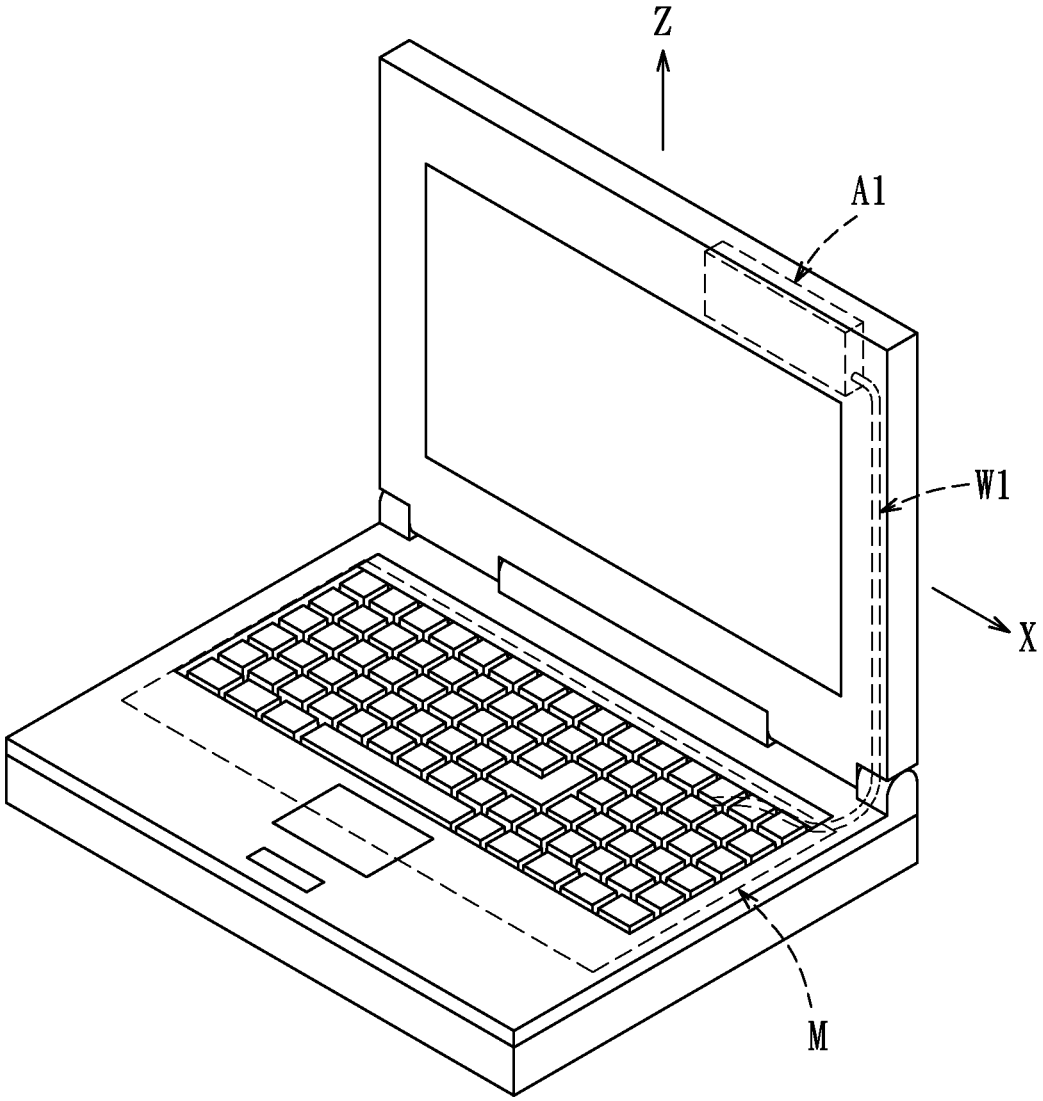
FIG. 1 is a perspective view of an electronic device provided with a multi-band antenna according to the first embodiment of the present invention.

Before the present invention is described in greater detail, it should be noted that like elements are denoted by the same reference numerals throughout the disclosure.

Figure 2:
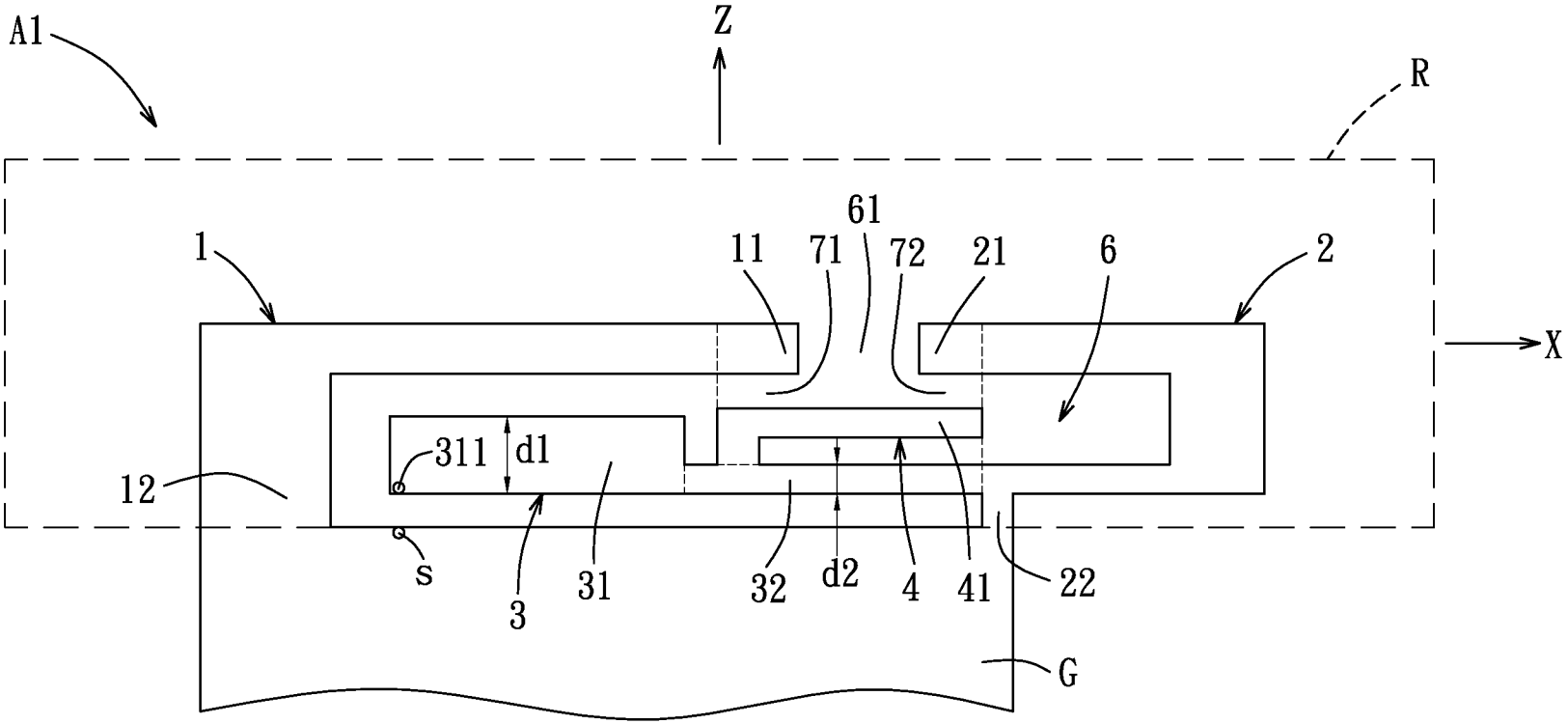
FIG. 2 is a schematic diagram of the multi-band antenna according to the first embodiment of the present invention.

Referring to FIG. 1 and FIG. 2, an electronic device according to the first embodiment of the present invention includes a circuit module (M), a first multi-band antenna (A1) and a first coaxial cable (W1).

The first multi-band antenna (A1) includes a ground plane (G) and a radiating unit (R). The ground plane (G) includes a short point (s) electrically connected to an outer conductor of the first coaxial cable (W1).

The radiating unit (R) includes a first radiating arm 1, a second radiating arm 2, a feed-in arm 3 and a coupling arm 4.

The first radiating arm 1 is substantially L-shaped, and includes a first free end portion 11 and a first connecting end portion 12. The first connecting end portion 12 is electrically connected to the ground plane (G), and the first free end portion 11 is spaced apart from and projectively overlaps a portion of the ground plane (G) in a first direction (Z).

The second radiating arm 2 is substantially U-shaped, and includes a second free end portion 21 and a second connecting end portion 22. The second connecting end portion 22 is electrically connected to the ground plane (G), and the second free end portion 21 is spaced apart from and projectively overlaps a portion of the ground plane (G) in the first direction (Z). The first radiating arm 1, the second radiating arm 2 and the ground plane (G) cooperate to define an inner space 6. The first free end portion 11 and the second free end portion 21 face each other and are spaced apart from each other in a second direction (X) perpendicular to the first direction (Z), and define an opening 61 in spatial communication with the inner space 6 therebetween.

The feed-in arm 3 is disposed in the inner space 6, is spaced apart from the ground plane (G), and includes a feed-in segment 31 and a connecting segment 32. The feed-in segment 31 is disposed between the first radiating arm 1 and the ground plane (G), and includes a signal feed-in point 311 electrically connected to an inner conductor of the first coaxial cable (W1) for exchanging a radio frequency (RF) signal with the circuit module (M). The connecting segment 32 is spaced apart from and projectively overlaps the opening 61 of the inner space 6 in the first direction (Z), extends in the second direction (X) across the first and second free end portions 11 and 21 and the opening 61, and is electrically connected between the feed-in segment 31 and the ground plane (G).

According to the first embodiment, the feed-in segment 31 has an electrical length substantially equal to an electrical length of the connecting segment 32, and a dimension (d1) greater than a dimension (d2) of the connecting segment 32 in the first direction (Z) by two to three times. By adjusting a ratio of the dimension (d1) of the feed-in segment 31 to the dimension (d2) of the connecting segment 32, field intensity distribution of the feed-in arm 3 can be adjusted for impedance matching.

The coupling arm 4 is disposed in the inner space 6, and has a substantially L-shaped main coupling segment 41 electrically connected to the connecting segment 32. The main coupling segment 41 is spaced apart from and projectively overlaps the first free end portion 11 and the second free end portion 21 in the first direction (Z) to define a first coupling gap 71 and a second coupling gap 72, respectively. As a result, the main coupling segment 41 is able to exchange electromagnetic energy with the first free end portion 11 and the second free end portion 21 by capacitive coupling through the first coupling gap 71 and the second coupling gap 72, respectively.

Figure 3:
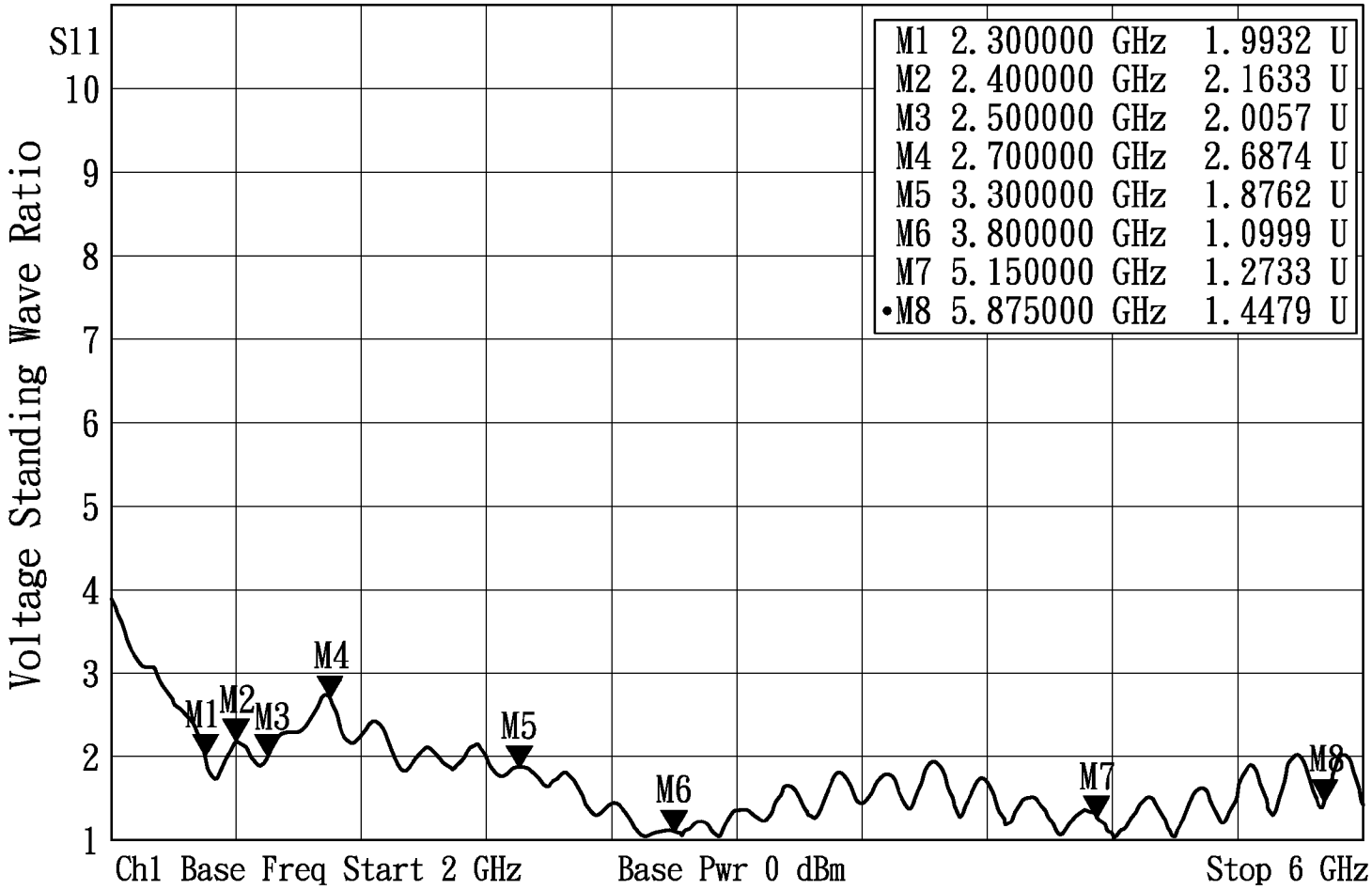
FIG. 3 is a Voltage Standing Wave Ratio plot of the multi-band antenna according to the first embodiment.

FIG. 3 is a Voltage Standing Wave Ratio (VSWR) plot of the first multi-band antenna (A1) according to the first embodiment. From FIG. 3, the first multi-band antenna (A1) according to the first embodiment is able to generate three different resonant modes corresponding to first, second and third frequency bands (i.e., 2.3~2.5 GHz, 3.3~3.8 GHz and 5.15~5.875 GHz), respectively. In particular, the feed-in segment 31 of the feed-in arm 3 and the first radiating arm 1 are configured to make the first multi-band antenna (A1) operate in the first frequency band (2.3~2.5 GHz), the coupling arm 4 and the second radiating arm 2 are configured to make the first multi-band antenna (A1) operate in the second frequency band (3.3~3.8 GHz), and the coupling arm 4 and the feed-in arm 3 are configured to make the first multi-band antenna (A1) operate in the third frequency band (5.15~5.875 GHz).

Figure 4:
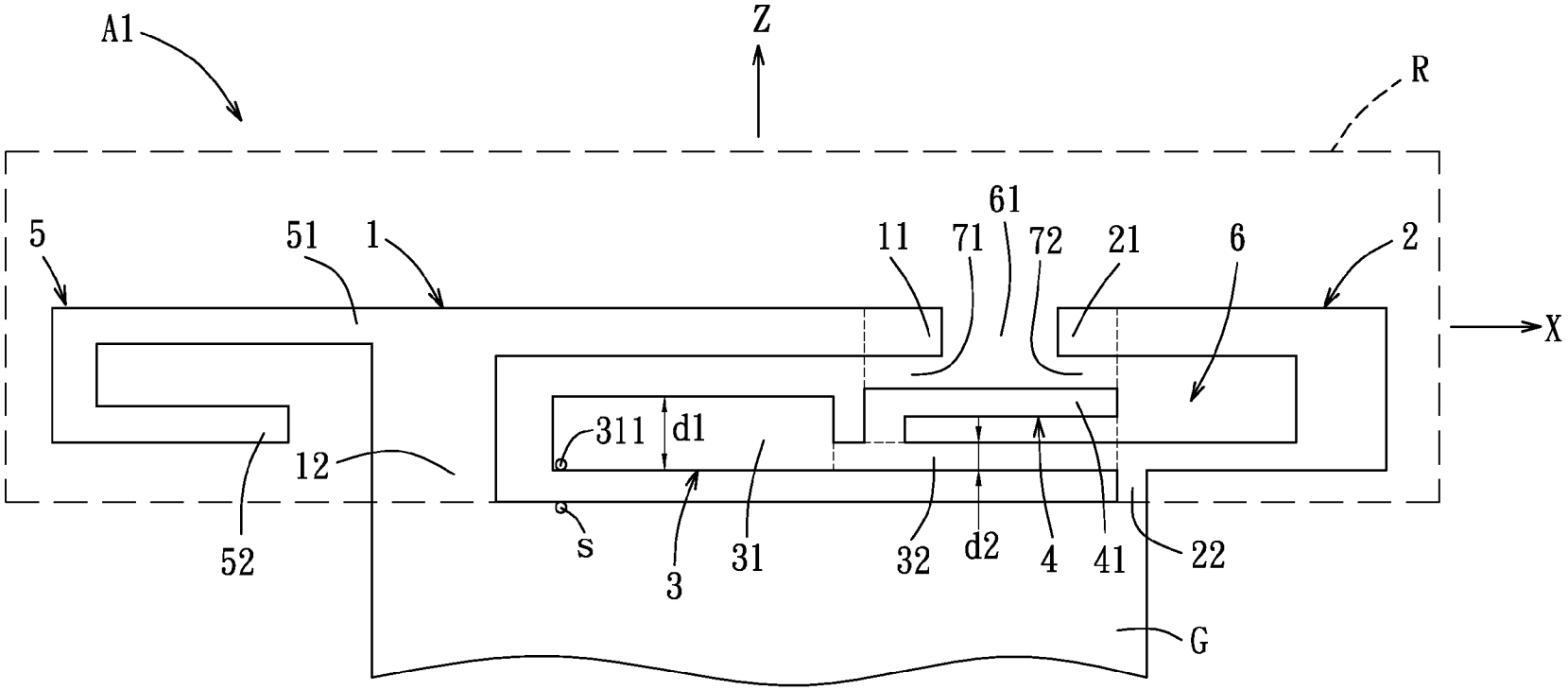
FIG. 4 is a schematic diagram of a multi-band antenna according to the second embodiment of the present invention.

Referring to FIG. 4, the electronic device according to the second embodiment of this invention is similar to the first embodiment. In the second embodiment, the radiating unit (R) of the first multi-band antenna (A1) further includes a parasitic element 5 arranged along the first radiating arm 1 in the second direction (X). The parasitic element 5 is substantially U-shaped, and has a free end 52 and a connecting end 51 electrically connected to the first radiating arm 1. The parasitic arm 5 is configured to resonate in a fourth frequency band (i.e., 2.5~2.7 GHz) near the first frequency band, and is configured for impedance matching.

Figure 5:
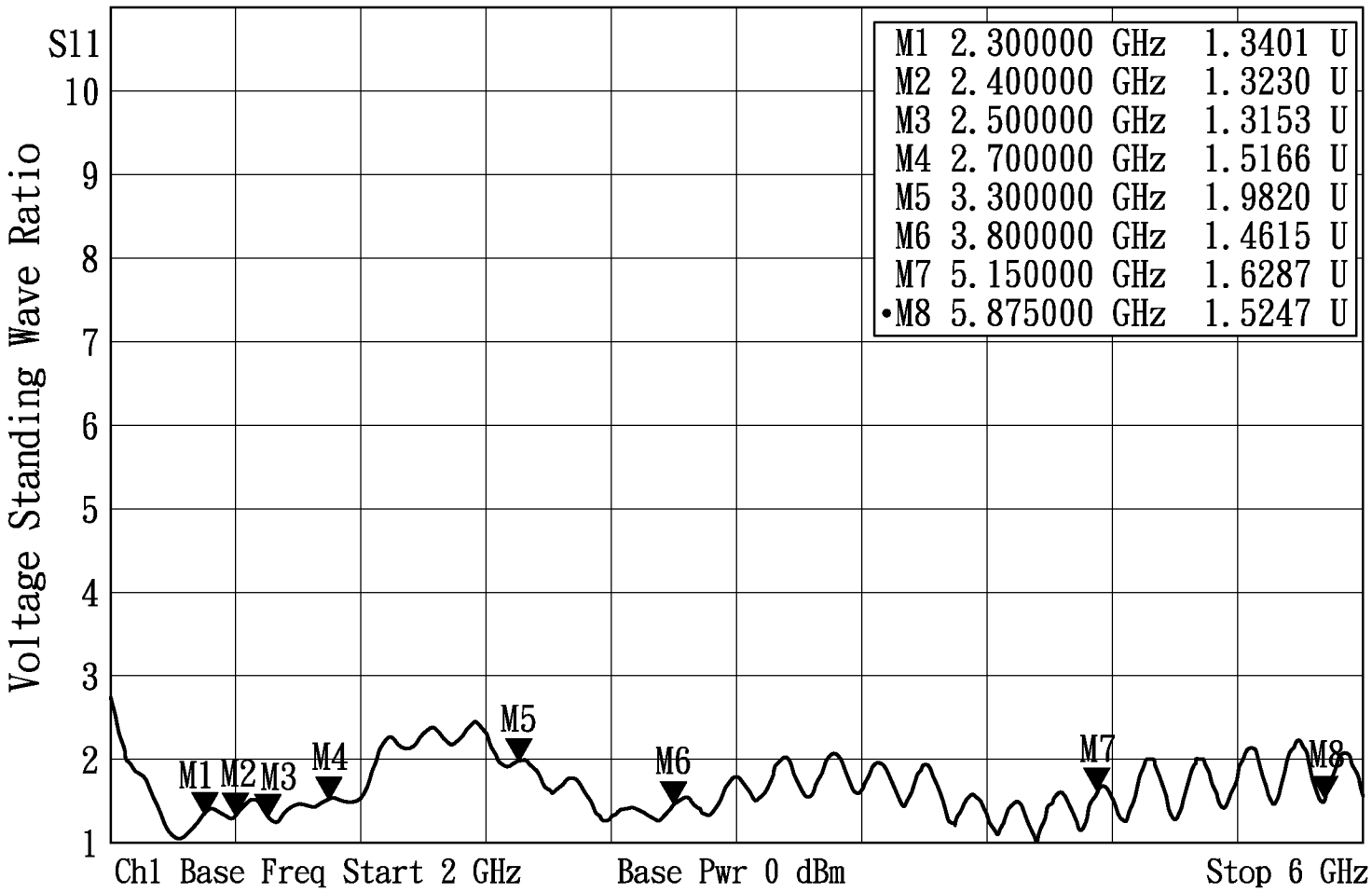
FIG. 5 is a Voltage Standing Wave Ratio plot of the multi-band antenna according to the second embodiment.

FIG. 5 is a Voltage Standing Wave Ratio plot of the first multi-band antenna (A1) according to the second embodiment shown in FIG. 4. Compared with the first multi-band antenna (A1) covering a low frequency band of 2.3~2.5 GHz (i.e., the first frequency band) according to the first embodiment with reference to FIG. 3, FIG. 5 shows that the first multi-band antenna (A1) according to the second embodiment covers a broader low frequency band (2.3~2.7 GHz) consisting of the first frequency band (2.3~2.5 GHz) and the fourth frequency band (2.5~2.7 GHz).

Figure 6:
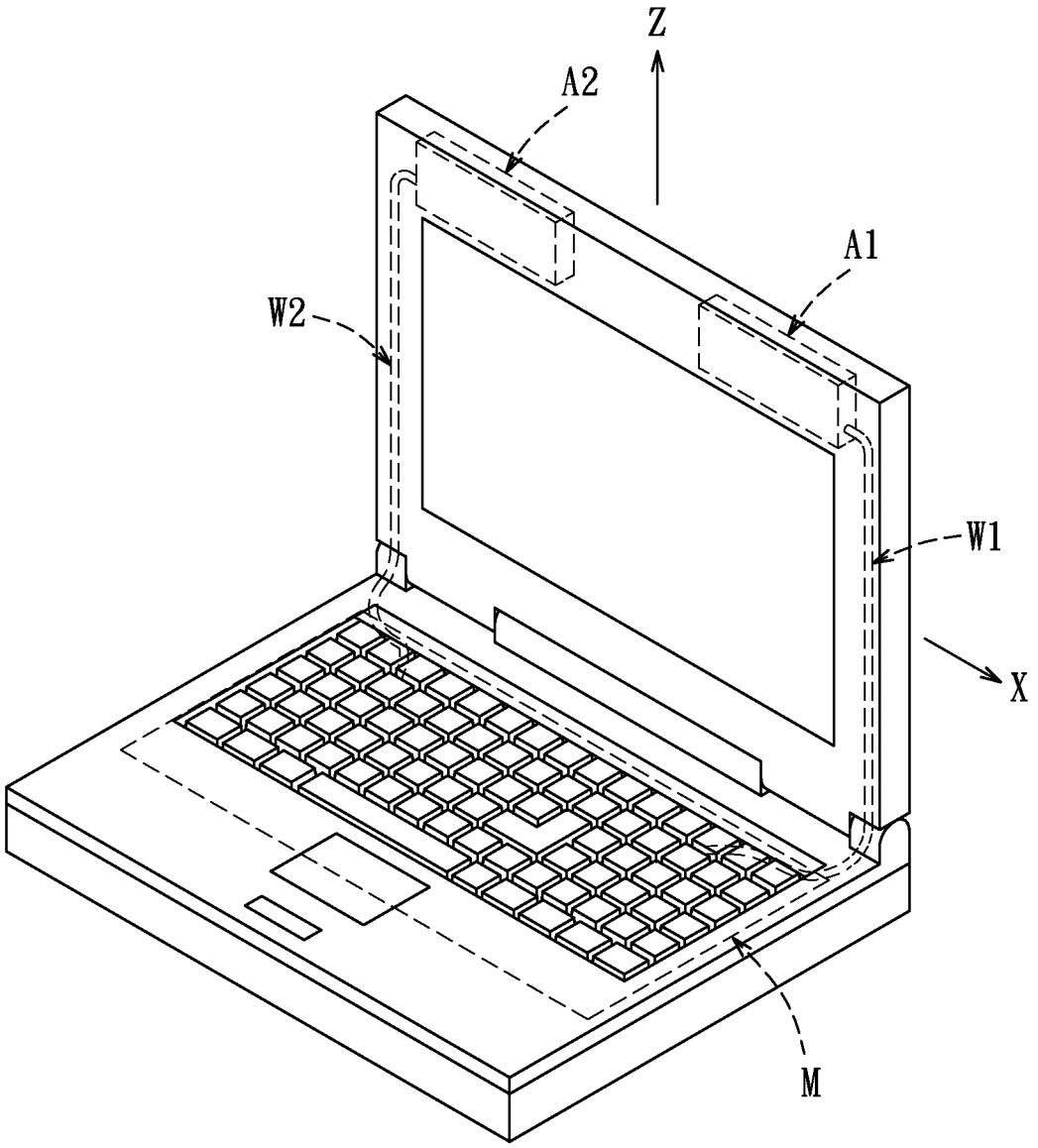
FIG. 6 is a perspective view of an electronic device provided with a pair of multi-band antennas according to the third embodiment of the present invention.
Figure 7:
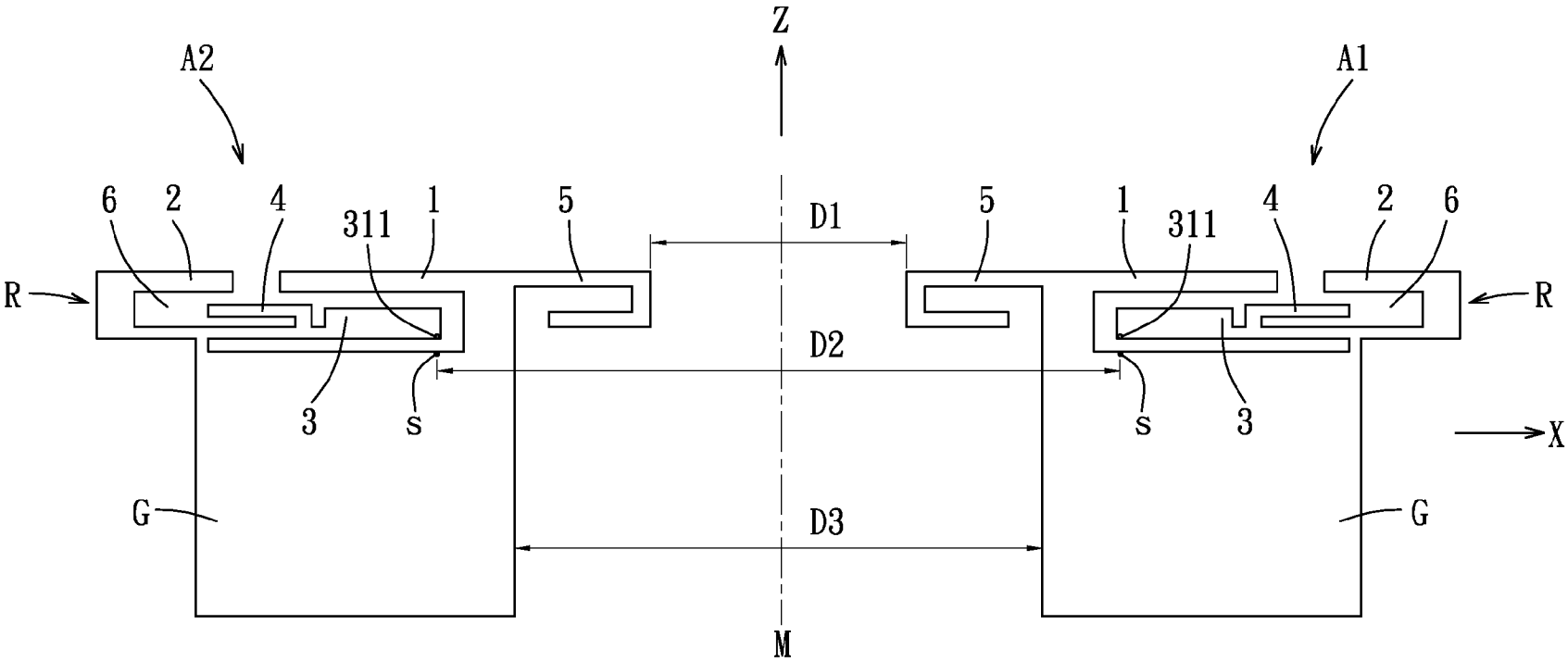
FIG. 7 is a schematic diagram of the multi-band antennas according to the third embodiment of the present invention.

Referring to FIG. 6 and FIG. 7, the electronic device according to the third embodiment of this invention further includes a second multi-band antenna (A2) and a second coaxial cable (W2). The first multi-band antenna (A1) and the second multi-band antenna (A2) are substantially the same, and operate in the same frequency bands (2.3~2.7 GHz, 3.3~3.8 GHz, and 5.15~5.875 GHz). In this embodiment, the first and second multi-band antennas (A1), (A2) are arranged in the second direction (X), and are mirrored about a midline (M), which extends in the first direction (Z), such that respective sides of the first and second multi-band antenna (A1), (A2) having the parasitic elements 5 face each other. In this embodiment, the first multi-band antenna (A1) and the second multi-band antenna (A2) are far from each other and are disposed at opposite sides of the electronic device in the second direction (X). For example, a first distance (D1) between the parasitic elements 5 is equal to 21 mm, a second distance (D2) between the short points (s) is equal to 57 mm, and a third distance (D3) between the ground planes (G) is equal to 43 mm. However, in other embodiments, the first multi-band antenna (A1) and the second multi-band antenna (A2) may be disposed at the same side of the electronic device so as to be adjacent to each other. In addition, the first multi-band antenna (A1) and the second multi-band antenna (A2) may be disposed at a hinge area or other positions, and a distance therebetween may be adjusted based on the design of the electronic device.

Figure 8:
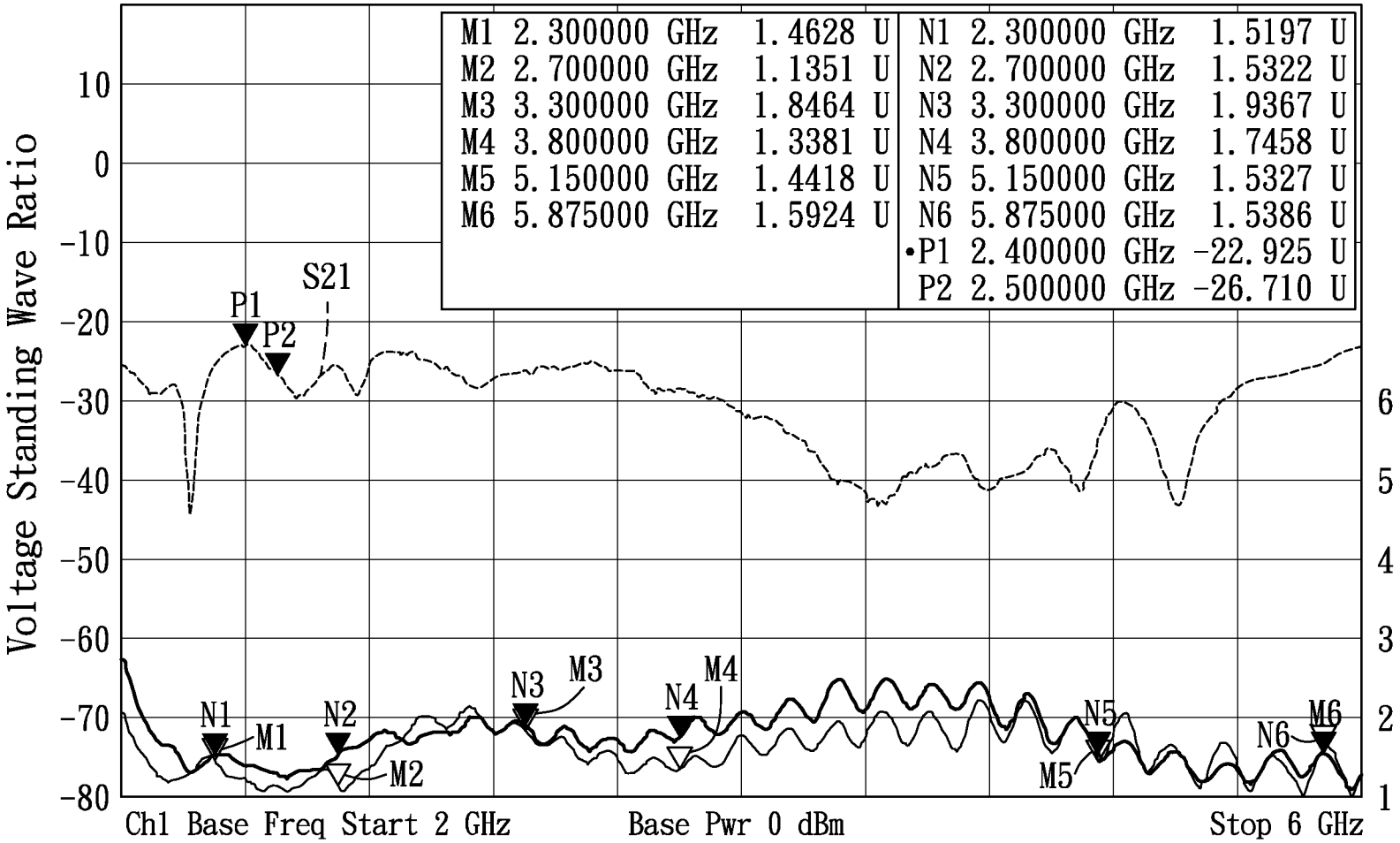
FIG. 8 is a plot illustrating insertion loss between the multi-band antennas according to the third embodiment.

FIG. 8 is a plot showing insertion loss (S21) between the first multi-band antenna (A1) and the second multi-band antenna (A2) with respect to frequency according to the third embodiment. From FIG. 8, the insertion loss (S21) between the first multi-band antenna (A1) and the second multi-band antenna (A2) is smaller than −20 dB, that is to say, the first multi-band antenna (A1) and the second multi-band antenna (A2) have high isolation therebetween.

Figure 9:
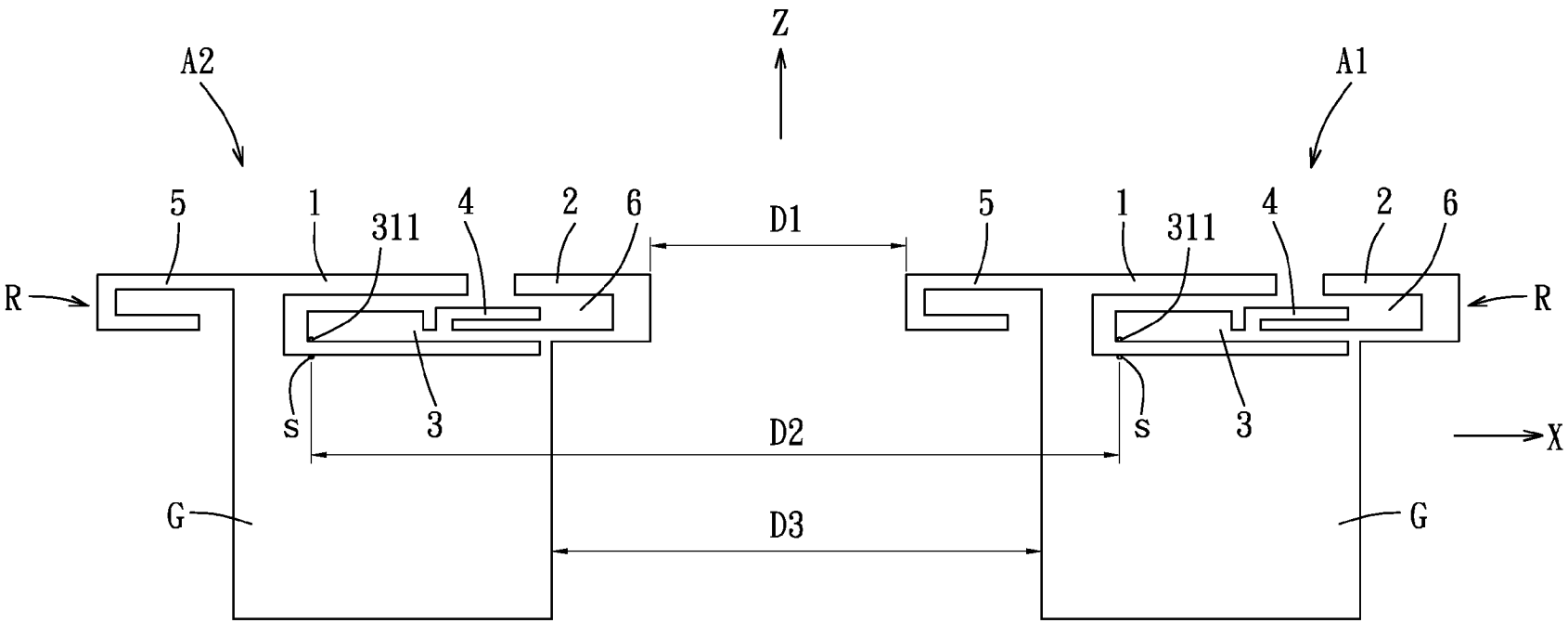
FIG. 9 is a schematic diagram of a pair of multi-band antennas according to the fourth embodiment of the present invention.

Referring to FIG. 9, the electronic device according to the fourth embodiment of this invention is similar to the third embodiment. In this embodiment, the first multi-band antenna (A1) and the second multi-band antenna (A2) are spaced apart from each other, are disposed at the opposite sides of the electronic device (as shown in FIG. 6), and are arranged side by side in the second direction (X) with identical orientation. For example, a first distance (D1) between the parasitic element 5 of the first multi-band antenna (A1) and the second radiating arm 2 of the second multi-band antenna (A2) is equal to 21 mm, a second distance (D2) between the short points (s) is equal to 66 mm, and a third distance (D3) between the ground planes (G) is equal to 40 mm.

Figure 10:
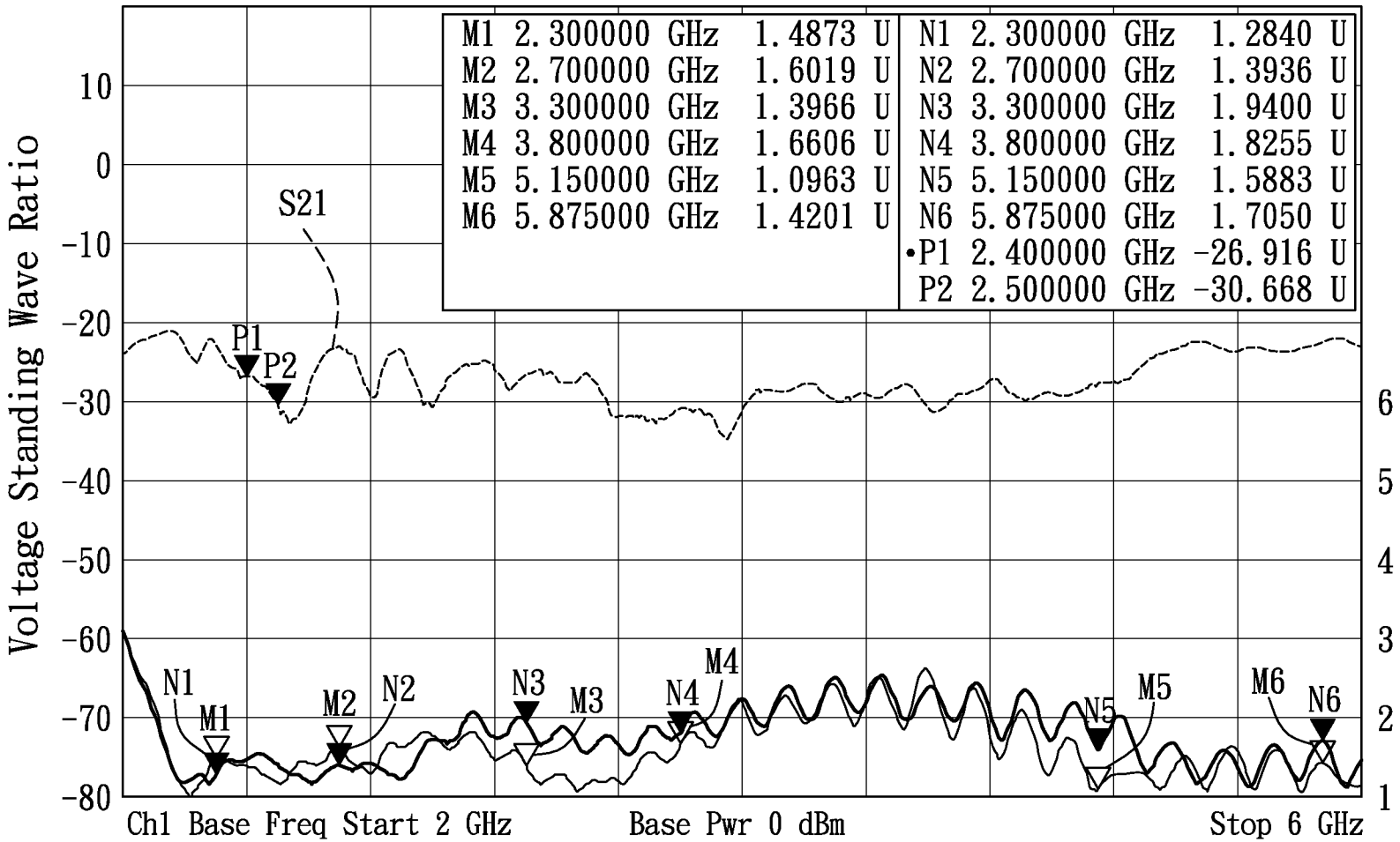
FIG. 10 is a plot illustrating insertion loss between the multi-band antennas according to the fourth embodiment.

FIG. 10 is a plot showing the insertion loss (S21) between the first multi-band antenna (A1) and the second multi-band antenna (A2) with respect to frequency according to the fourth embodiment. From FIG. 10, the insertion loss (S21) between the first multi-band antenna (A1) and the second multi-band antenna (A2) is smaller than −20 dB.

Figure 11:
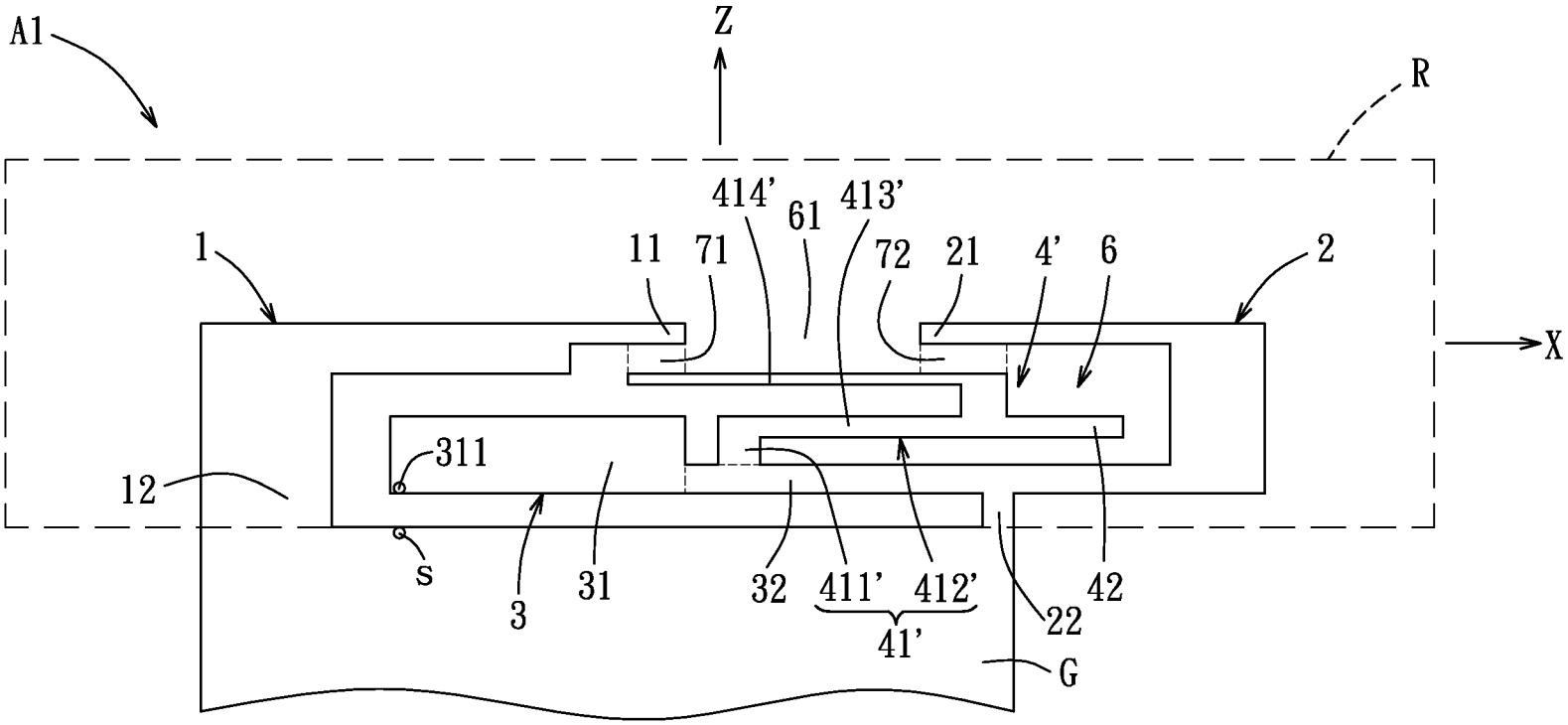
FIG. 11 is a schematic diagram of a multi-band antenna according to the fifth embodiment of the present invention.

Referring to FIG. 11, the electronic device according to the fifth embodiment of this invention is similar to the first embodiment. The difference resides in a coupling arm 4' different from the coupling arm 4 of the first embodiment in shape. The coupling arm 4' according to the fifth embodiment includes a main coupling segment 41' and an extension coupling segment 42. The main coupling segment 41' is disposed in the inner space 6, and includes a connecting section 411' electrically connected to the connecting segment 32 of the feed-in arm 3 and a U-shaped section 412'. The U-shaped section 412' includes a first segment 413' electrically connected to the connecting section 411', and a second segment 414' parallel to the first segment 413' and projectively overlapping the first and second free end portions 11 and 21 in the first direction (Z) The extension coupling segment 42 is electrically connected to the main coupling segment 41', and is surrounded by the second radiating arm 2, resulting in relatively stronger energy coupling between the coupling arm 4' and the second radiating arm 2.

Figure 12:
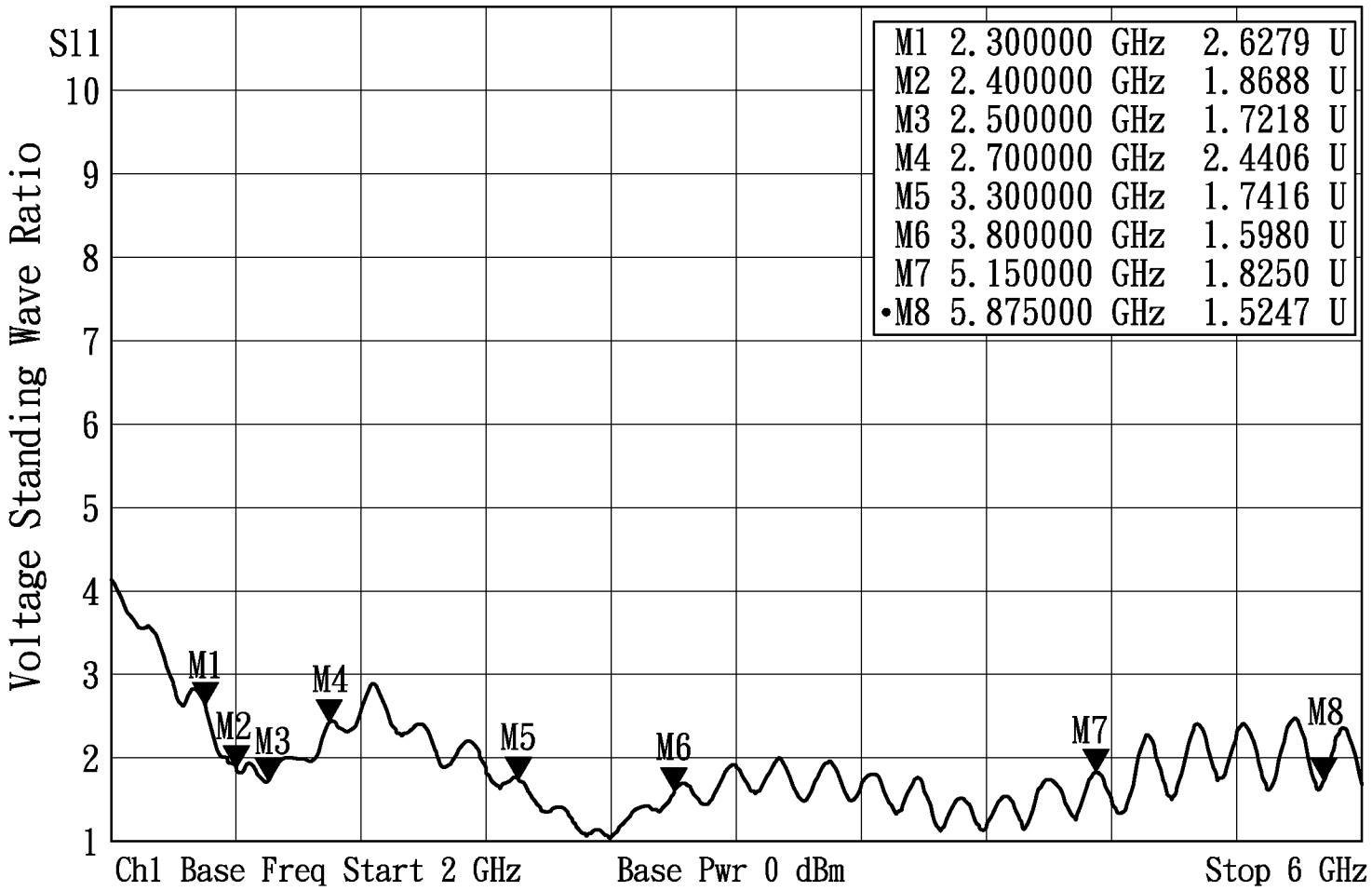
FIG. 12 is a Voltage Standing Wave Ratio plot of the multi-band antenna according to the fifth embodiment.

FIG. 12 is a Voltage Standing Wave Ratio plot of the first multi-band antenna (A1) according to the fifth embodiment shown in FIG. 11. From FIG. 12, the first multi-band antenna (A1) according to the fifth embodiment is able to cover the first to third frequency bands (i.e., 2.4~2.5 GHz, 3.3~3.8 GHz and 5.15~5.875 GHz).

Figure 13:
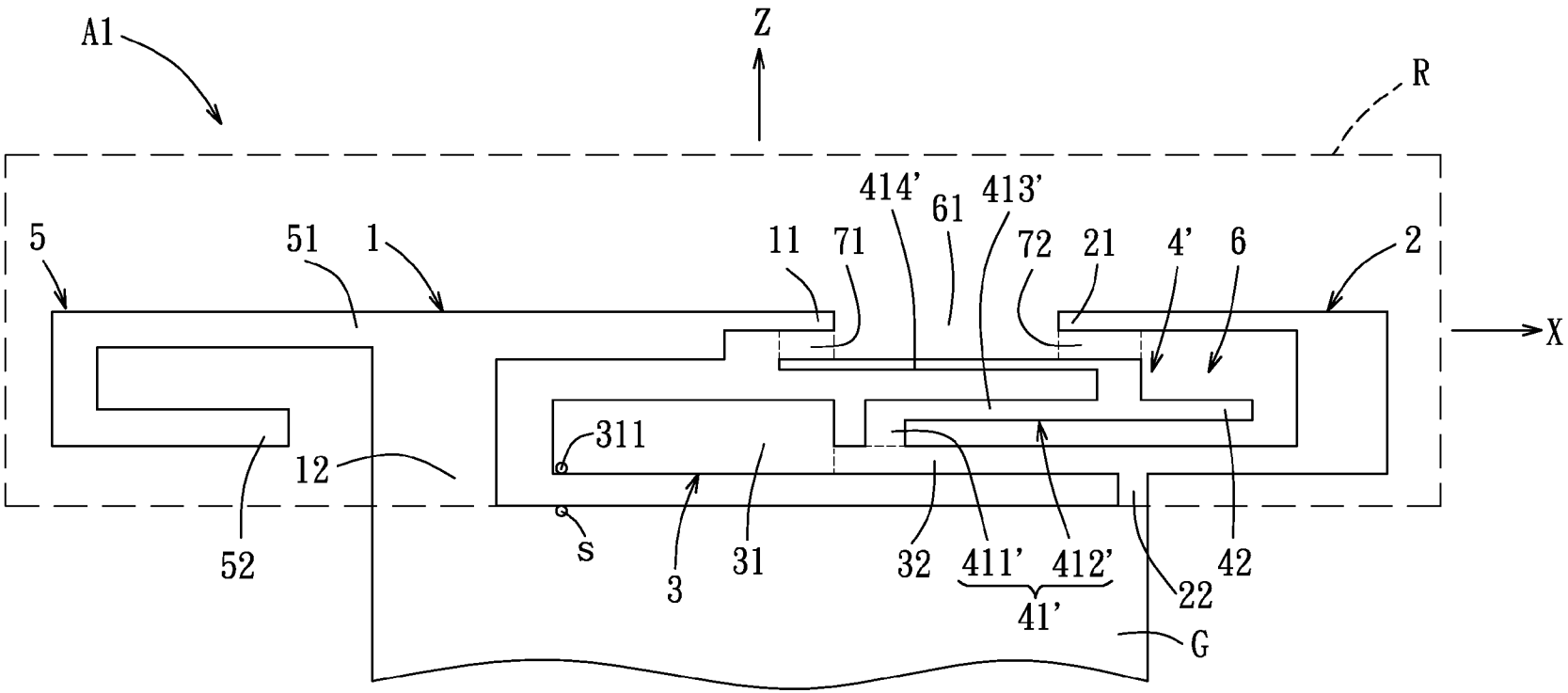
FIG. 13 is a schematic diagram of a multi-band antenna according to the sixth embodiment of the present invention.

Referring to FIG. 13, the electronic device according to the sixth embodiment of this invention is similar to the fifth embodiment. In this embodiment, the radiating unit (R) of the first multi-band antenna (A1) further includes the parasitic element 5. The parasitic element 5 has the free end 52 and the connecting end 51 electrically connected to the first radiating arm 1. The parasitic arm 5 resonates in the fourth frequency band (2.5~2.7 GHz), and is configured for impedance matching.

Figure 14:
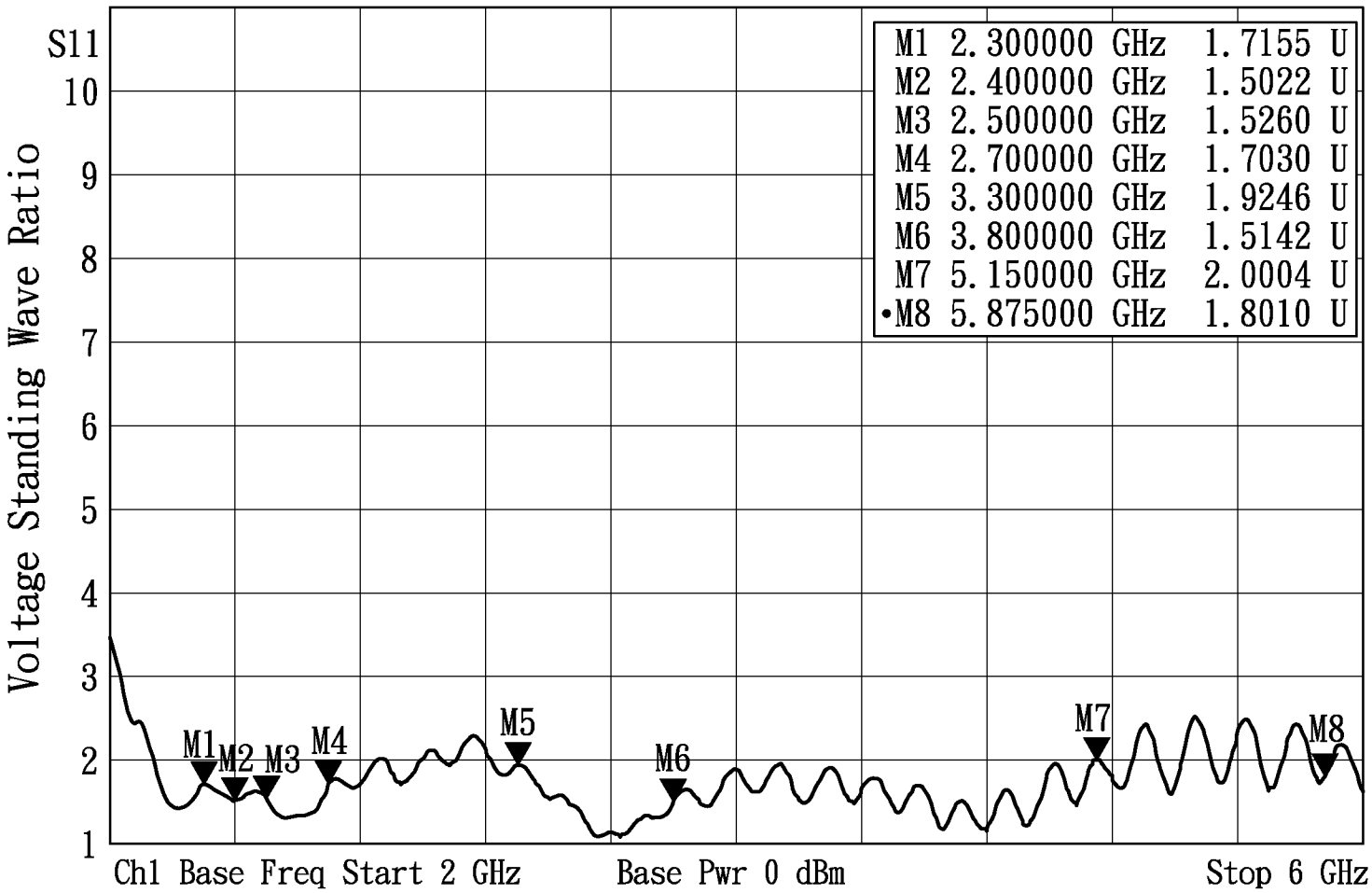
FIG. 14 is a Voltage Standing Wave Ratio plot of the multi-band antenna according to the sixth embodiment.

FIG. 14 is a Voltage Standing Wave Ratio plot of the first multi-band antenna (A1) according to the sixth embodiment shown in FIG. 13. Compared with the first multi-band antenna (A1) covering a low frequency band of 2.4~2.5 GHz according to the fifth embodiment with reference to FIG. 12, FIG. 14 shows that the first multi-band antenna (A1) according to the sixth embodiment covers a broader low frequency band (2.3~2.7 GHz) consisting of the first frequency band (2.3~2.5 GHz) and the fourth frequency band (2.5~2.7 GHz).

Figure 15:
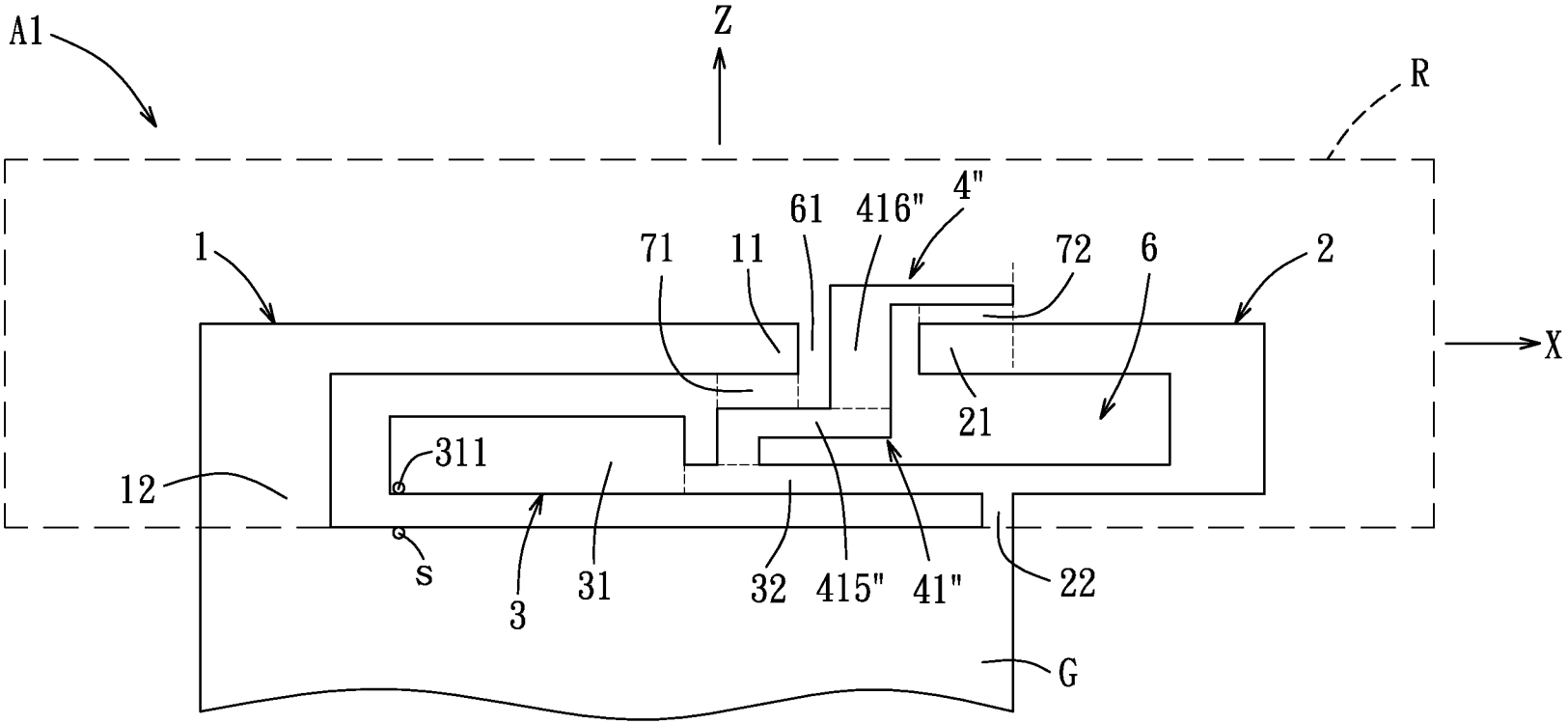
FIG. 15 is a schematic diagram of a multi-band antenna according to the seventh embodiment of the present invention.

Referring to FIG. 15, the electronic device according to the seventh embodiment of this invention is similar to the first embodiment. The difference resides in a coupling arm 4" different from the coupling arm 4 of the first embodiment in shape. In this embodiment, the coupling arm 4" includes a main coupling segment 41" including a first L-shaped section 415" and a second L-shaped section 416" electrically connected to the first L-shaped section 415". The first L-shaped section 415" is disposed in the inner space 6, projectively overlaps the first free end portion 11 of the first radiating arm 1 in the first direction (Z), and has one end part electrically connected to the connecting segment 32 of the feed-in arm 3 and the other end part electrically connected to the second L-shaped section 416". The second L-shaped section 416" extends outwardly through the opening 61 of the inner space 6, and projectively overlaps the second free end portion 21 of the second radiating arm 2 in the first direction (Z).

Figure 16:
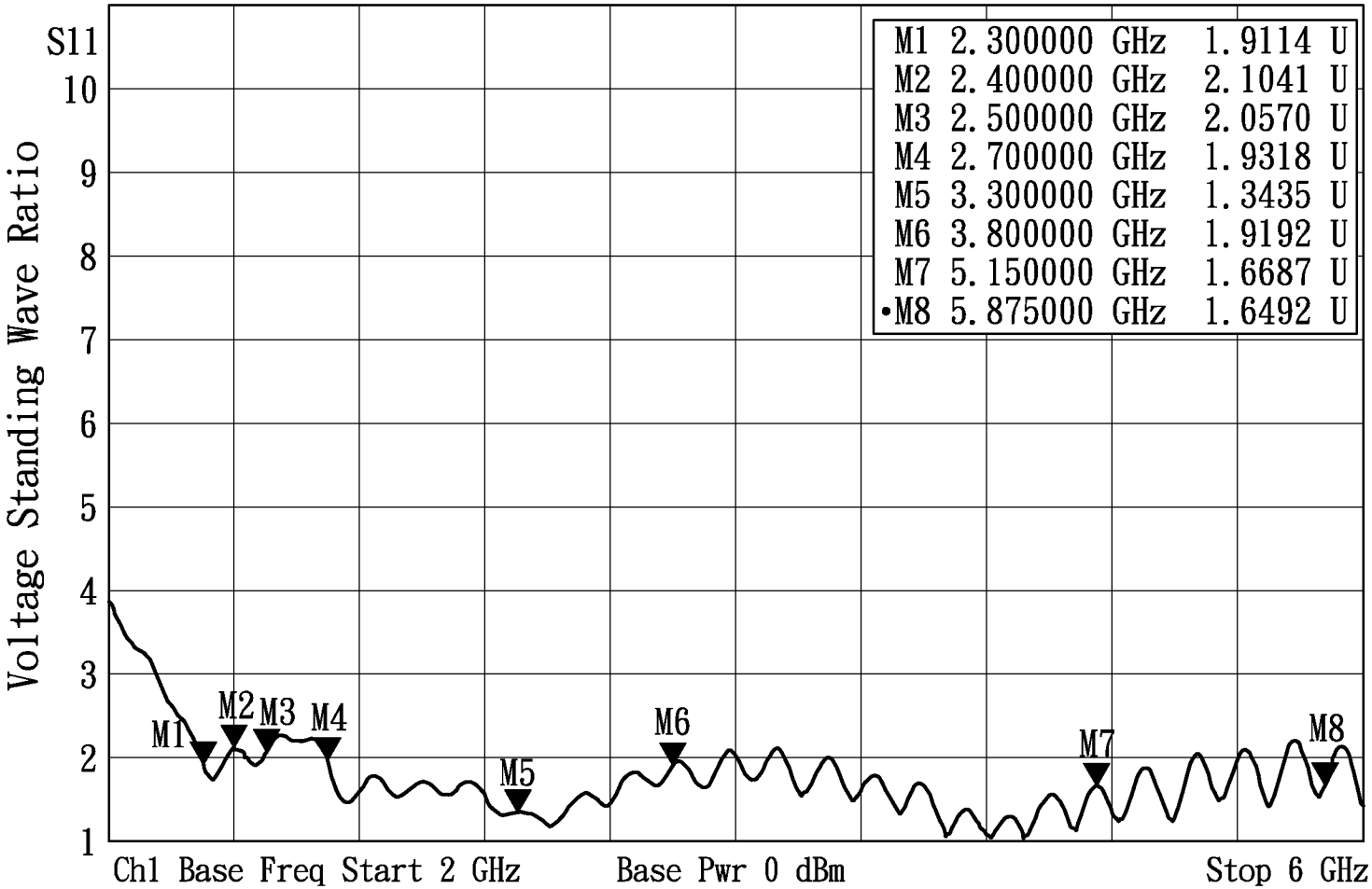
FIG. 16 is a Voltage Standing Wave Ratio plot of the multi-band antenna according to the seventh embodiment.

FIG. 16 is a Voltage Standing Wave Ratio plot of the first multi-band antenna (A1) according to the seventh embodiment shown in FIG. 15. From FIG. 16, the first multi-band antenna (A1) according to the seventh embodiment covers the first to third frequency bands (2.3~2.5 GHz, 3.3~3.8 GHz and 5.15~5.875 GHz).

Figure 17:
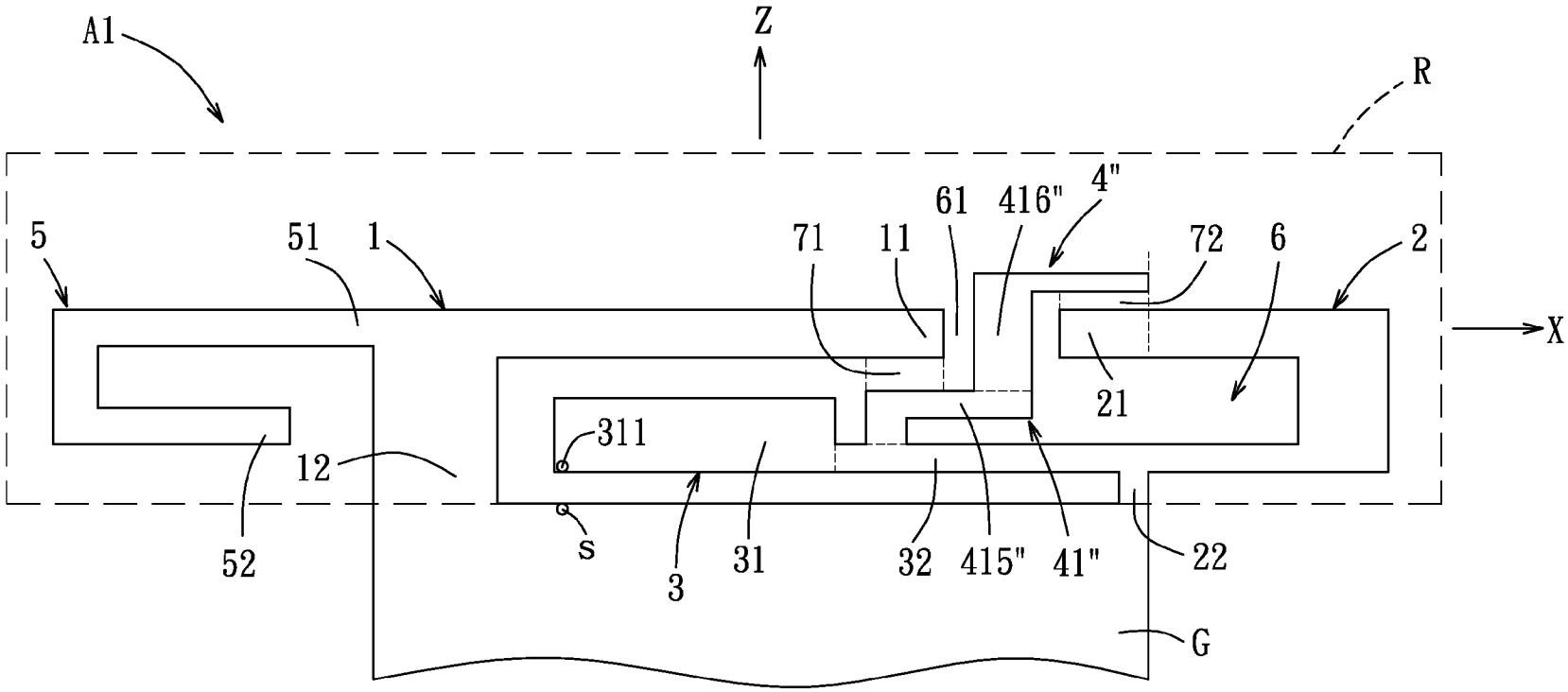
FIG. 17 is a schematic diagram of a multi-band antenna according to the eight embodiment of the present invention.

Referring to FIG. 17, the electronic device according to the eighth embodiment of this invention is similar to the seventh embodiment. In this embodiment, the radiating unit (R) of the first multi-band antenna (A1) further includes the parasitic element 5. The parasitic element 5 has the free end 52 and the connecting end 51 electrically connected to the first radiating arm 1. The parasitic arm 5 resonates in the fourth frequency band (2.5~2.7 GHz), and is configured for impedance matching.

Figure 18:
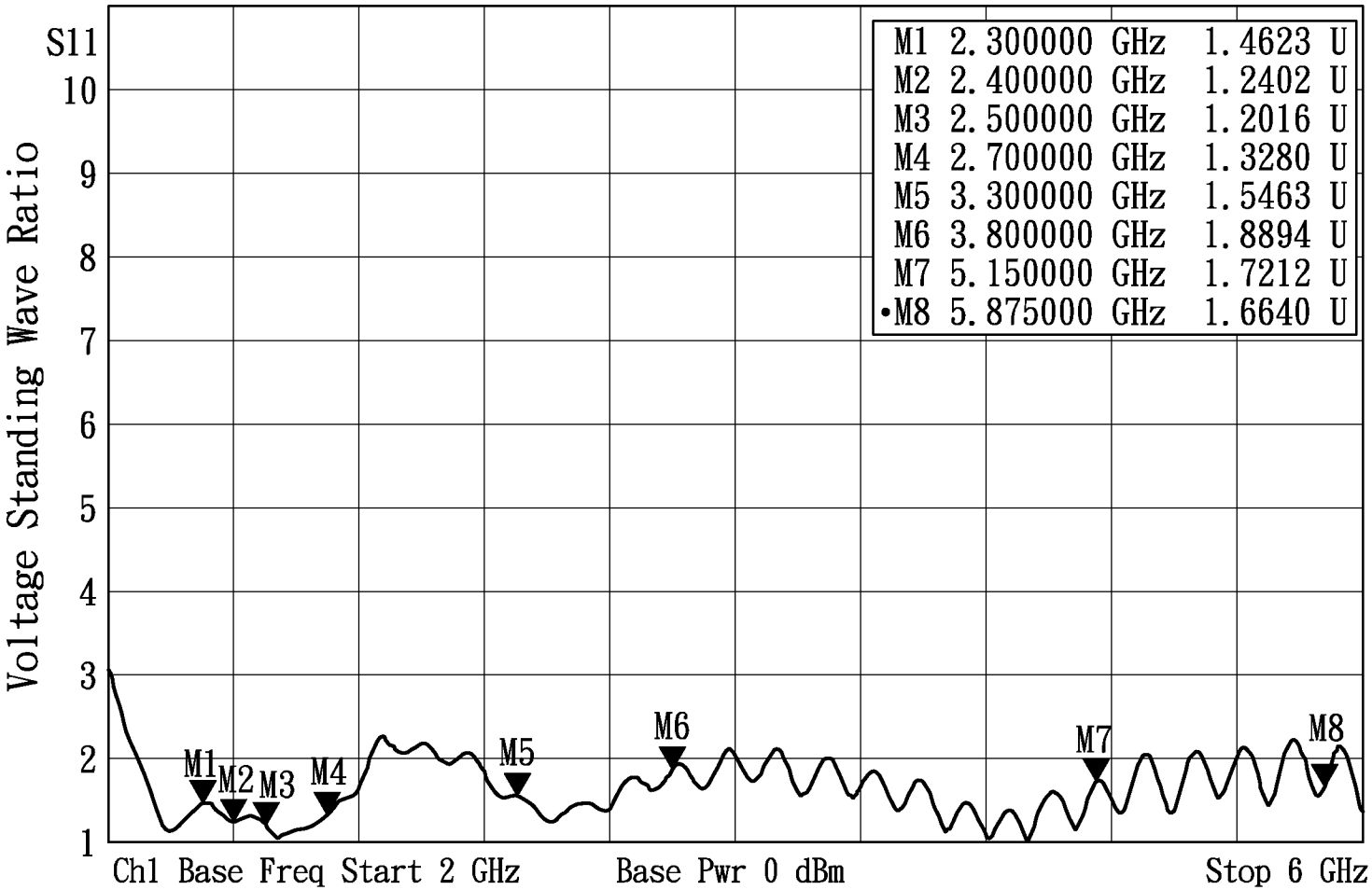
FIG. 18 is a Voltage Standing Wave Ratio plot of the multi-band antenna according to the eighth embodiment.

FIG. 18 is a Voltage Standing Wave Ratio plot of the first multi-band antenna (A1) according to the eighth embodiment shown in FIG. 17. Compared with the first multi-band antenna (A1) covering a low frequency band of 2.3~2.5 GHz according to the seventh embodiment with reference to FIG. 16, FIG. 18 shows that the first multi-band antenna (A1) according to the eighth embodiment covers a broader low frequency band (2.3~2.7 GHz) consisting of the first frequency band (2.3~2.5 GHz) and the fourth frequency band (2.5~2.7 GHz).

To conclude, the multi-band antennas (A1) and (A2) have the following advantages.

1. The multi-band antenna (A1), (A2) covers three frequency bands so as to enable the electronic device to wirelessly communicate using Wireless Local Area Network (WLAN) (2.4~2.5 GHz and 5.15~5.875 GHz) and Worldwide Interoperability for Microwave Access (WiMAX) (3.3~3.8 GHz).

2. By virtue of the parasitic element 5, the multi-band antenna (A1), (A2) may cover a relatively broader low frequency band so as to further enable the electronic device to wirelessly communicate using WiMAX of 2.3~2.7 GHz.

3. By virtue of the parasitic elements 5, the insertion loss between the first and second multi-band antennas (A1) and (A2) for signal diversity is reduced.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A multi-band antenna, comprising: a ground plane; and a radiating operable over at least two different frequency bands and unit including: a substantially L-shaped first radiating arm having a first connecting end portion electrically connected to said ground plane, and a first free end portion that is spaced apart from and physically overlaps a portion of said ground plane in a first direction, a substantially U-shaped second radiating arm having a second connecting end portion electrically connected to said ground plane, and a second free end portion that is spaced apart from and physically overlaps a portion of said ground plane in the first direction, said second radiating arm cooperating with said first radiating arm and said ground plane to define an inner space therein, said first and second free end portions facing each other and defining an opening in spatial communication with said inner space therebetween, a feed-in arm disposed in said inner space and including a connecting segment electrically connected to said ground plane and physically overlapping said opening in the first direction, and a feed-in segment electrically connected to said connecting segment and disposed between said first radiating arm and said ground plane, said feed-in segment including a signal feed-in point, and a coupling arm including a main coupling segment electrically connected to said connecting segment and physically overlapping said first and second free end portions in the first direction.

2. The multi-band antenna as claimed in claim 1, wherein said radiating unit further includes a parasitic element electrically connected to said first radiating arm.

3. The multi-band antenna as claimed in claim 1, wherein said feed-in segment has an electrical length substantially equal to an electrical length of said connecting segment, and has a dimension greater than a dimension of said connecting segment in the first direction by two to three times.

4. The multi-band antenna as claimed in claim 1, wherein said coupling arm further includes an extension coupling segment electrically connected to said main coupling segment and surrounded by said second radiating arm.

5. The multi-band antenna as claimed in claim 1, wherein said main coupling segment of said coupling arm is disposed in said inner space, and includes: a connecting section electrically connected to said connecting segment of said feed-in arm; and a U-shaped section having a first segment electrically connected to said connecting section, and a second segment parallel to said first segment and physically overlapping said first and second free end portions in the first direction.

6. The multi-band antenna as claimed in claim 1, wherein said main coupling segment of said coupling arm includes a first L-shaped section disposed in said inner space and physically overlapping said first free end portion of said first radiating arm in the first direction, and a second L-shaped section electrically connected to said first L-shaped section, extending outwardly through said opening, and physically overlapping said second free end portion of said second radiating arm in the first direction.

7. An electronic device, comprising: a circuit module; and a first multi-band antenna electrically connected to said circuit module, and including a ground plane and a radiating unit that is operable over at least two different frequency bands and includes a substantially L-shaped first radiating arm having a first connecting end portion electrically connected to said ground plane, and a first free end portion that is spaced apart from and physically overlaps a portion of said ground plane in the first direction, a substantially U-shaped second radiating arm having a second connecting end portion electrically connected to said ground plane, and a second free end portion that is spaced apart from and physically overlaps a portion of said ground plane in the first direction, said second radiating arm cooperating with said first radiating arm and said ground plane to define an inner space therein, said first and second free end portions facing each other and defining an opening in spatial communication with said inner space therebetween, a feed-in arm disposed in said inner space and including a connecting segment electrically connected to said ground plane and physically overlapping said opening in the first direction, and a feed-in segment electrically connected to said connecting segment and disposed between said first radiating arm and said ground plane, said feed-in segment including a signal feed-in point coupled to said circuit module, and a coupling arm including a main coupling segment electrically connected to said connecting segment and physically overlapping said first and second free end portions in the first direction.

8. The electronic device as claimed in claim 7, wherein said radiating unit of said first multi-band antenna further includes a parasitic element electrically connected to said first radiating arm.

9. The electronic device as claimed in claim 8, further comprising a second multi-band antenna adjacent to said first radiating arm of said first multi-band antenna, wherein said second multi-band antenna and said first multi-band antenna operate in the same frequency band.

10. The electronic device as claimed in claim 9, wherein said second multi-band antenna has a structural configuration that is substantially same as a structural configuration of said first multi-band antenna.

11. The electronic device as claimed in claim 7, wherein said feed-in segment has an electrical length substantially equal to an electrical length of said connecting segment, and has a dimension greater than a dimension of said connecting segment in the first direction by two to three times.

12. The electronic device as claimed in claim 7, wherein said coupling arm further includes an extension coupling segment electrically connected to said main coupling segment and surrounded by said second radiating arm.

13. The electronic device as claimed in claim 7, wherein said main coupling segment of said coupling arm is disposed in said inner space, and includes: a connecting section electrically connected to said connecting segment of said feed-in arm; and a U-shaped section having a first segment electrically connected to said connecting section, and a second segment parallel to said first segment and physically overlapping said first and second free end portions in the first direction.

14. The multi-band antenna as claimed in claim 7, wherein said main coupling segment of said coupling arm includes a first L-shaped section disposed in said inner space and physically overlapping said first free end portion of said first radiating arm in the first direction, and a second L-shaped section electrically connected to said first L-shaped section, extending outwardly through said opening, and physically overlapping said second free end portion of said second radiating arm in the first direction.

* * * * *